US005154424A

United States Patent [19]

Lo

[11] Patent Number: 5,154,424

[45] Date of Patent: Oct. 13, 1992

[54] HEAD OF A GOLF CLUB

[76] Inventor: Kun-Nan Lo, No. 33, Hsiang-Ho Rd., Li-Lin Tsun, Tan-Tzu Hsiang, Taiwan

[21] Appl. No.: 638,271

[22] Filed: Jan. 7, 1991

[51] Int. Cl.[5] ..... A63B 53/04

[52] U.S. Cl. ..... 273/167 H; 273/169; 273/174

[58] Field of Search ..... 273/164–200

[56] References Cited

U.S. PATENT DOCUMENTS

| | | | |
|---|---|---|---|
| 1,433,744 | 10/1922 | Rhind | 273/172 |
| 1,497,578 | 6/1924 | Mothersele | 273/172 |
| 1,509,429 | 9/1924 | Hillerich | 273/172 |
| 1,538,415 | 5/1925 | Tootle et al. | 273/172 |
| 2,002,108 | 5/1935 | Child | 273/171 X |
| 3,356,782 | 12/1967 | Whyte | 273/171 X |
| 3,692,306 | 9/1972 | Glover | 273/172 X |
| 4,043,563 | 8/1977 | Churchward | 273/171 |
| 4,052,075 | 10/1977 | Daly | 273/171 |
| 4,489,945 | 12/1984 | Kobayashi | 273/172 X |
| 4,602,787 | 7/1986 | Sugioka et al. | 273/171 |
| 4,795,159 | 1/1989 | Nagamoto | 273/171 |
| 4,834,387 | 5/1989 | Waites et al. | 273/172 X |

FOREIGN PATENT DOCUMENTS

| | | | |
|---|---|---|---|
| WO8802642 | 4/1988 | European Pat. Off. | 273/169 |

*Primary Examiner*—William H. Grieb
*Assistant Examiner*—Sebastiano Passaniti
*Attorney, Agent, or Firm*—Panitch Schwarze Jacobs & Nadel

[57] ABSTRACT

A head of a golf club includes a hollow body which has a bottom side and a recess formed at the bottom side; an adhesive material; a weight received in the recess, the adhesive material provided in the recess and surrounding the weight for adhering and fixing the weight in the recess; a screw member having a shank; and a bottom cover with a hole, the cover being secured to the bottom side to cover the weight by the shank of the screw member passing upwardly through the hole of the bottom cover into the recess and adhering to the adhesive material.

2 Claims, 3 Drawing Sheets

HEAD OF A GOLF CLUB

BACKGROUND OF THE INVENTION

1. Field of the Invention

The present invention relates to a head of a golf club, more particularly to a head of a golf club which has a weight in a recess at a bottom side of the head.

2. Description of the Prior Art

Referring to FIG. 1, a conventional golf club includes a shaft and a head. The head is provided with a metal weight (not shown) adjacent to the side 8 opposite to the striking face.

The head of the conventional golf club has a body 1 filled with foam material 3; a bottom side with a plurality of mounting holes 2 each of which extends from said bottom side into said foam material 3 of said body 1; a bottom cover 4 with a plurality of holes 5; a plurality of screws 7, the shanks of the screws 7 respectively passing upwardly through the holes 5 of the bottom cover 4 to be received in the mounting holes 2, the heads of the screws 7 remaining under the bottom cover 4; and adhesive material 6 respectively provided in the mounting holes 2, in contact with the foam material 3, and surrounding the shanks of the screws 7 for adhering to and fixing the shanks in the mounting holes 2, so that the bottom cover 4 is secured to the bottom side.

The above conventional head has a high center of gravity because of the location of its weight. Therefore, while holding the shaft of the golf club to strike a ball, the arm of force formed upon striking is short, and the moment of force created thereby is small, so that the ball can not go a long distance.

Upon striking a ball, the force of impact makes the head shake and causes the deformation of the foam material 3. Because the adhesive material 6 provided in the mounting hole 2 is in contact with the foam material 3 and surrounds the shank of the screw 7 for securing the bottom cover 4 to the bottom side, the deformation of the foam material, 3 loosens the adhesive material 6, it partially loses its grip on the shank of the screw 7 in the mounting hole 2, which results in some degree of loosening of the bottom cover 4.

SUMMARY OF THE INVENTION

Therefore, the objective of the present invention is to provide a head of a golf club which has a weight in a recess in the bottom of the head. More specifically, this invention relates to a head of a golf club with a lower center of gravity than a conventional one. In addition, the head of this invention has a bottom cover firmly secured to the bottom side thereof to cover and contain the weight.

Accordingly, a head of a golf club of the present invention includes a hollow body which has a bottom side and a recess formed in the bottom side; an adhesive material; and a weight received in the recess, the adhesive material provided in the recess and surrounding the weight for adhering and fixing the weight in the recess. The head of the golf club further includes a screw member having a shank, and a bottom cover to cover the weight secured to the bottom side by the shank of the screw member passing upwardly through a hole in the bottom cover into the recess, and adhering to the adhesive material.

BRIEF DESCRIPTION OF THE DRAWINGS

Other features and advantages of this invention will become apparent in the following detailed description of the preferred embodiment with reference to the accompanying drawings, in which.

DETAILED DESCRIPTION OF THE PREFERRED EMBODIMENT

Figure 1:
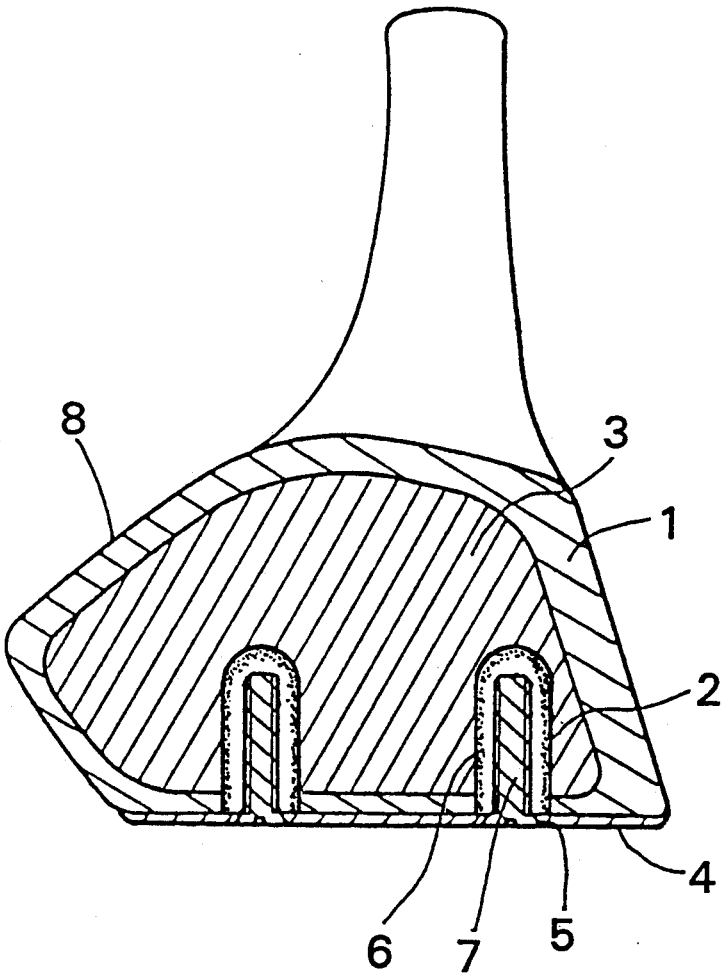
Fig. 1 PRIOR ART
FIG. 1 is a sectional view of a head of a golf club of the prior art.
Figure 2:
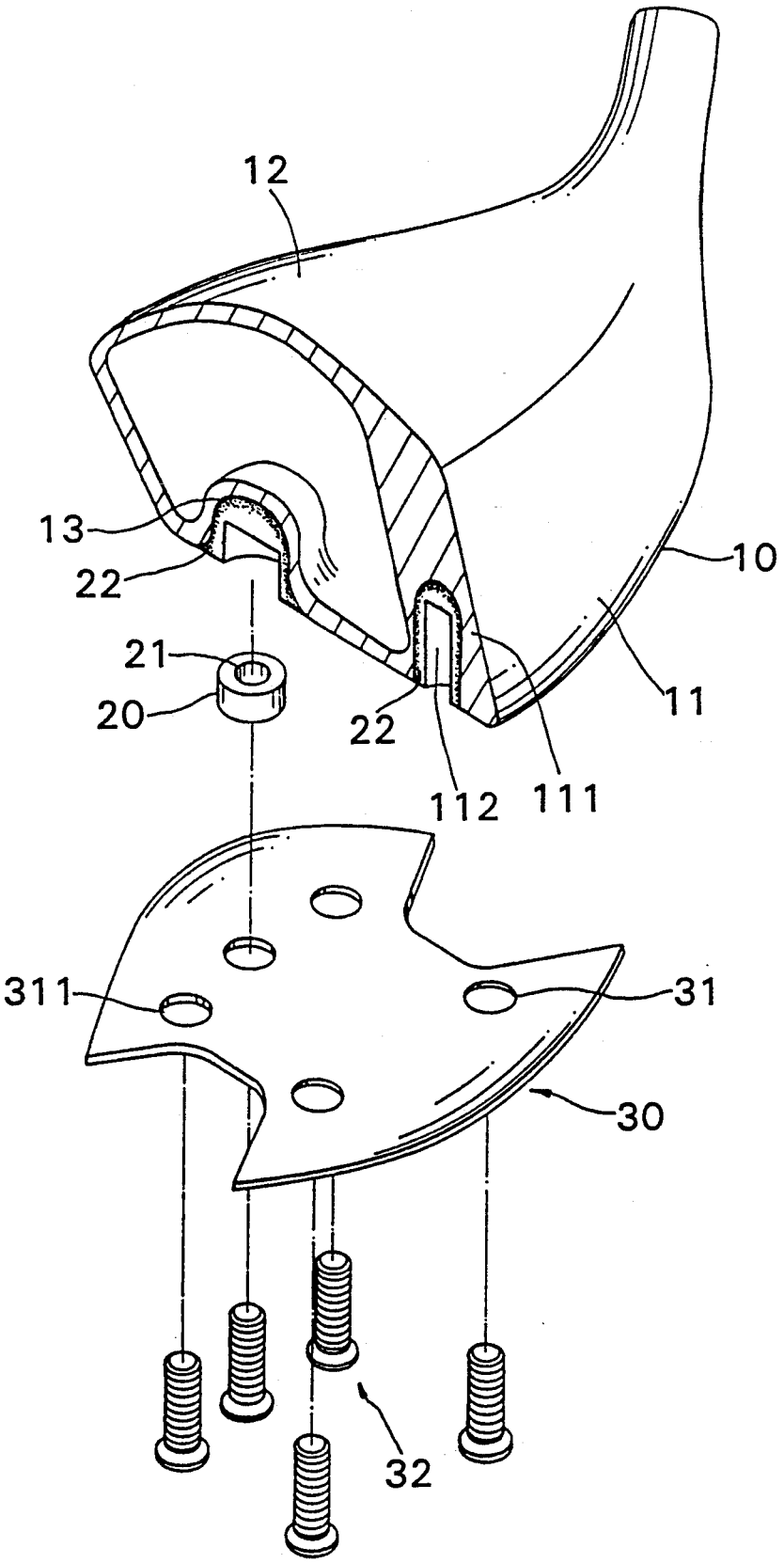
FIG. 2 is a perspective exploded view of the preferred embodiment of a head of a golf club of the present invention.
Figure 3:
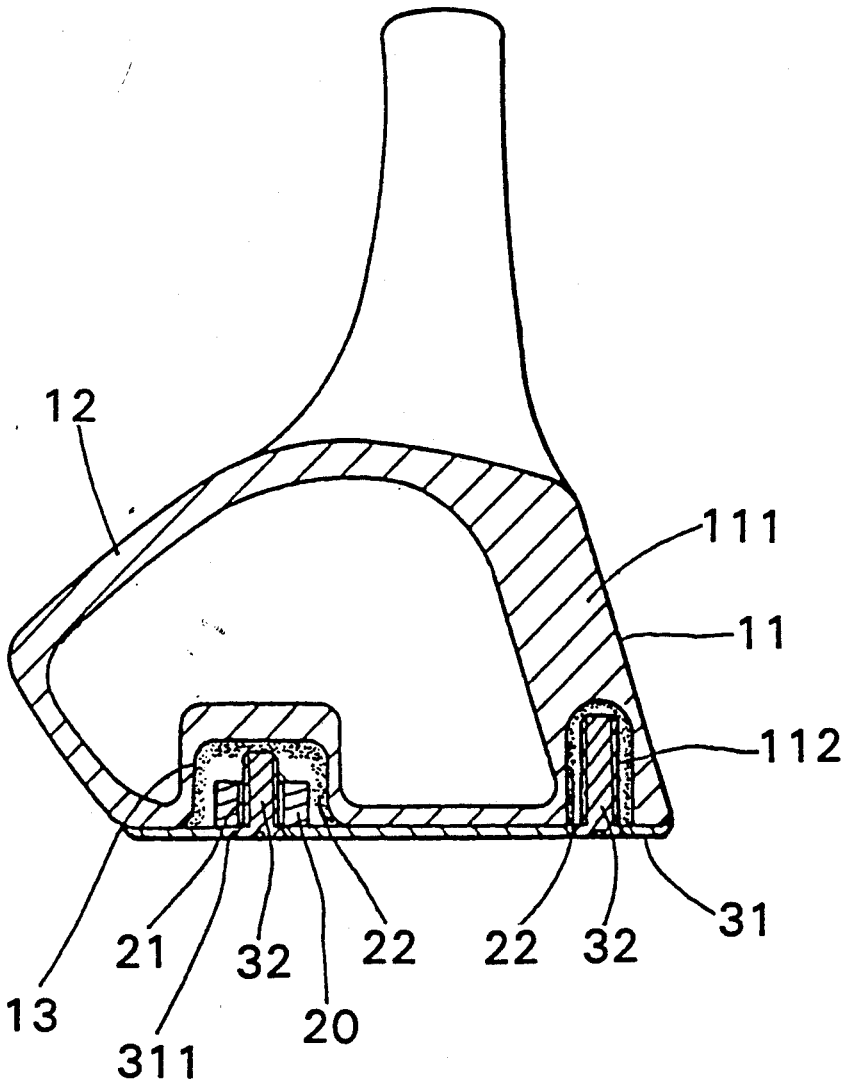
FIG. 3 is a sectional view of the preferred embodiment of the head of the golf club of the present invention shown in FIG. 2.

Referring to FIGS. 2 and 3, a head of a golf club of the present invention includes a hollow body 12 made of carbon fiber which has a face 11, a wall 111, a bottom side 10, a recess 13 formed in the bottom side 10, and a plurality of mounting holes 112 extending from the bottom side 10 into the wall 111; an adhesive material 22 made of epoxy resin; and a weight 20 made of metal with a central hole 21 received in the recess 13. The center of gravity of the head of this invention is at the bottom of the head.

The head further includes a bottom cover 30 with a plurality of holes 31 and a hole 311; and a plurality of screws 32, the shanks of the screws 32 respectively passing upwardly through the holes 31 of the bottom cover 30 into the mounting holes 112, one of the shanks of the screws 32 passing through the hole 311 of the bottom cover 30 and the central hole 21 of the weight 20 into the recess 13, the heads of the screws 32 remaining under the bottom cover 30. The adhesive material 22 is provided in the recess 13 and surrounds the weight 20 and the shank of the screw 32 associated with the weight 20 for adhering and fixing the weight 20 and the shank of that screw 32 in the recess 13. The adhesive material 22 is also provided in the mounting holes 112 and surrounds the shanks of the screws 32 thereof for adhering and fixing the shanks in the mounting holes 112. Thus the bottom cover 30 is firmly secured to the bottom side of the head.

Accordingly, the center of gravity of the head is at the bottom thereof. Therefore, while holding the shaft of the golf club to strike a ball, the arm of force upon striking is longer, the moment of force created thereby is larger, and the ball will go a longer distance. In addition, the bottom cover 30 is not loosened because it is firmly secured to the bottom side.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A head of a golf club comprising:

an enclosed hollow body having a bottom side and a recess within said bottom side;

an adhesive material;

a weight member dimensioned to be located within said recess;

said adhesive material being provided within said recess and engaging both said weight member and an inner periphery of said recess for adhering and affixing said weight member within said recess;

a threaded member having a shank;

a bottom cover having a hole, said cover being securable to said bottom side to cover said weight member;

said shank of said threaded member being dimensioned to upwardly pass through said hole of said bottom cover and terminate within said recess; and said adhesive material engaging both said shank and a portion of said inner periphery of said recess for adhering and affixing said shank within said recess.

2. A head of a golf club as in claim 1, wherein said weight member has a central hole for receiving said shank of said threaded member, said shank being dimensioned to pass upwardly through both said hole of said bottom cover and said central hole of said weight member and into said recess.

* * * * *